US005110449A

United States Patent [19]

Venardos et al.

[11] Patent Number: 5,110,449

[45] Date of Patent: May 5, 1992

[54] OXYGEN ADDITION TO A COKING ZONE AND SLUDGE ADDITION WITH OXYGEN ADDITION

[75] Inventors: Dean G. Venardos, Batavia; Shri K. Goyal, Naperville, both of Ill.

[73] Assignee: Amoco Corporation, Chicago, Ill.

[21] Appl. No.: 716,790

[22] Filed: Jun. 18, 1991

Related U.S. Application Data

[63] Continuation-in-part of Ser. No. 285,110, Dec. 15, 1988, Pat. No. 5,041,207, which is a continuation-in-part of Ser. No. 937,990, Dec. 4, 1986, abandoned.

[51] Int. Cl.[5] ..... C10G 9/14; C10G 11/00

[52] U.S. Cl. ..... 208/131; 208/50; 208/48 R; 201/25

[58] Field of Search ..... 208/131

[56] References Cited

U.S. PATENT DOCUMENTS

| | | | |
|---|---|---|---|
| 2,347,805 | 5/1944 | Bell | 208/50 |
| 3,917,564 | 11/1975 | Meyers | 208/131 |
| 3,960,704 | 6/1976 | Kegler et al. | 208/50 |
| 4,404,092 | 9/1983 | Audeh et al. | 208/131 |
| 4,534,851 | 8/1985 | Allan et al. | 208/482 |
| 4,874,505 | 10/1989 | Bartilucci et al. | 208/131 |
| 5,009,767 | 4/1991 | Bartilucci et al. | 208/131 |

*Primary Examiner*—Helane E. Myers

*Attorney, Agent, or Firm*—Scott P. McDonald; William H. Magidson; Ralph C. Medhurst

[57] ABSTRACT

A process is disclosed for sludge addition to a coking zone in which the sludge is contacted with oxygen. The sludge is then contacted with feed, liquid derived from the feed, or vapor derived from the feed. Oxygen also contacts the feed, liquid derived from the feed, or vapor derived from the feed to help maintain reaction temperature in the coking zone.

43 Claims, 2 Drawing Sheets

OXYGEN ADDITION TO A COKING ZONE AND SLUDGE ADDITION WITH OXYGEN ADDITION

CROSS-REFERENCE TO RELATED APPLICATIONS

This application is a continuation-in-part application based on copending application U.S. Ser. No. 285,110, filed Dec. 15, 1988, which is a continuation in part of application U.S. Ser. No. 937,990, filed Dec. 4, 1986, the latter abandoned, all the contents of which are incorporated into this application by specific reference thereto.

BACKGROUND OF THE INVENTION

1. Field of the Invention

The field of art to which this invention pertains is hydrocarbon coking operations in which feed, a liquid derived from the feed, or a vapor derived from the feed is contacted with oxygen at oxidation conditions to effect oxidation of a portion of the contacted material, and a mixture of sludge and oxygen is contacted with oxygen. The mixture of sludge and oxygen is contacted with at least a portion of the feed, liquid derived from the feed, or vapor derived from the feed in the coking zone.

2. General Background

Waste water sludge is produced in many industrial operations. Sludge production from a typical refinery or petrochemical plant can come from many sources including API separator bottoms, slop oil, emulsions, storage tank bottoms, sludge from heat exchangers, oily waste, MEA reclaimer sludges, and other waste materials produced in the refinery. The typical sludge will contain solids, which may be organic, inorganic or combinations of both, oil, and aqueous materials.

This sludge often contains hazardous materials which makes its disposal difficult and expensive. In most refinery or petrochemical operations the sludge-containing streams are sent to an API separator for gross removal of water and hydrocarbons after which the water and concentrated hydrocarbons and solids can be individually treated by land farming or other known waste treatment materials. At the present, however, there are regulations which prevent or severely restrict the use of land farming as a means of disposing of industrial sludges.

One of the problems associated with sludge addition to a cooking zone is temperature reduction which accompanies the addition of a relatively cool sludge to the zone. Temperature reduction contributes to increased coke yields which most refiners try to avoid since the liquid products from a typical refinery coker are more valuable than the solid coke produced.

One way to overcome temperature reduction attendant with sludge addition is to oxidize the sludge by contacting it with oxygen at conditions which will effect oxidation of certain components of the sludge, liberating heat as a result of heat of oxidation. If the oxidation conditions are suitably regulated, hydrocarbons contained in the sludge can be combusted to contributed substantial heat to the coking process. An additional advantage is that the sludge can be maintained at a higher temperature in the coking process which helps thermally convert hydrocarbons in the sludge and any toxic materials which may be present.

When oxygen addition to the sludge is coupled with oxygen addition to the feed, or liquid or vapor derived from the feed, the coking process can function at a higher overall temperature, thus increasing the production of valuable liquids and vapors from the coker feed while reducing the yield of solid coke.

In operating a coking process, the refiner generally aims to minimize coke production and maximize liquid products, since the liquid is more easily converted into gasoline or other materials having higher values than the solid coke material.

Higher temperatures in the coking zone reduce the solid coke yield and increase the more valuable liquid product yield; however, higher coking temperatures require increased feed furnace temperatures which may cause rapid coking in the furnace tubes and shortened on-stream time for the process. Lower temperatures produce soft coke, higher coke yield, and lower liquid yield, but permit longer on-stream time for the process.

The coke formation reactions are essentially endothermic with the temperature dropping in the coke zone. In an effort to maintain highest possible temperatures in the coke zone, the feed is preheated to a maximum temperature consistent with heater tube life. Adding sludge to the coking zone adds to the problem of maintaining high reaction temperatures in the coking zone since the sludge must be heated. Also by coking of the sludge added to the coker reduces coker temperature because of the endothermic nature of the coking reaction.

The process of this invention improves the ability of the coker operator to maintain reaction temperatures by contacting the sludge added to the coker during the coke production cycle with a gaseous stream comprising oxygen at conditions to effect oxidation of a portion of the sludge. This adds heat to the system and is done in connection with oxygen addition to the feed, liquid derived from the feed, or vapor derived from the feed to cause combustion of a portion of the feed.

Addition of the sludge and oxygen mixture to the coking zone may take place at any convenient location in the coke drum. The preferred locations, however, are in the feed or in the vapor section of the coke drum. In the latter case, sludge and oxygen mixture is generally added as a separate stream at oxidation conditions to effect contact of the sludge with the vapor products within the coke drum, oxidation of a portion of the sludge, and vaporization of at least a portion of the sludge.

By adding oxygen to the sludge and passing the mixture to the coking zone at conditions including a temperature sufficiently high to cause combustion of at least a portion of the organics in the sludge, a sufficiently high temperature results. This helps convert any combustible toxic materials in the sludge to harmless products. Additionally, some or all of the hydrocarbons in the sludge can be converted to more valuable liquid or vapor products with some production of coke. This also eliminates the need for land farms or other waste disposal methods which can add considerable expense to refinery operations.

To maximize coking zone temperatures, various methods have been used to increase the coker feed temperatures while reducing or minimizing any adverse effects accompanying these higher temperatures. Adding hot coke particles to the delayed coker feed has been disclosed. Adding oxygen-containing solids to the feed to increase temperature through oxidation of the feed passed into the coking zone is known. Additional methods for increasing coking zone temperatures include combustion of part of the feed or coke produced in the coker in a separate combustor which is heat exchanged with the coker feed.

U.S. Pat. No. 2,412,879 discloses a process in which a cellulosic material such as sawdust is added to delayed coker feed to reduce the amount of solid coke produced from the feedstock and to produce an easily-crushable and porous solid coke material. The cellulosic material is converted at least partially to charcoal.

U.S. Pat. No. 4,096,097 similarly teaches a process of producing high quality coke in a delayed coking process by adding an effective amount of an oxygen-containing carbonaceous material to the feed which decomposes at the high temperatures of the feed passing into the delayed coking drum. As disclosed in this patent, the oxygen content of the carbonaceous additive should be within the range from about 5 to 50 weight percent and usually no higher than 60 weight percent of the oxygen-containing material added to the feed. The carbonaceous materials which are taught to be effective include coal, lignite, and other materials such as sugar beet waste, sawdust, and other cellulosic wastes.

U.S. Pat. No. 4,302,324 also relates to an improved delayed coking process in which hot coke particles are added to the heated coker feedstock to raise its temperature by at least 50° F. The coke produced in this process is lower in volatiles and has improved mechanical strength, and the yield of liquid product is increased.

Another process involves coking hydrocarbon oils by contacting a feed with free oxygen in the presence of an aqueous liquid to product high quality coke and increase yields of liquid products from the coking reaction. This process is exemplified in U.S. Pat. Nos. 4,370,223 and 4,428,828. Sometimes the entire heat requirements for the process can be provided by the oxidation of the heavy hydrocarbon feed in the aqueous system with free oxygen.

Another process in which oxygen reacts with a residual feed is asphalt blowing. This process is exemplified in U.S. Pat. No. 3,960,704 in which isotropic petroleum coke is produced from a residual feedstock by blowing the feedstock with air until it has a desired softening temperature and subjecting the blown residuum to a delayed coking process.

The fluid bed coking art is replete with patents in which air or oxygen is added to a fluidized coking process to enhance fluid coke properties and decrease the need for external heat addition to the process. In particular, U.S. Pat. Nos. 2,537,153, 3,264,210, 3,347,781, 3,443,908, and 3,522,170 discuss various methods for using oxygen either directly injected into a fluid bed of coke or combusting a part of the fluid coke with the oxygen to supply additional heat to the bed process.

U.S. Pat. No. 2,347,805 (U.S. Class 190/65) is generally concerned with converting heavy oils to more valuable products and discloses the addition of oxygen or air to the feed passing into a coking still at conditions which inhibit formation of CO, $CO_2$ and other oxygenated bodies to assist in the upgrading of the feed to lighter products and coke.

U.S. Pat. No. 4,534,851 (U.S. Class 208/131) relates to the use of a plurality of injection nozzles to effect introduction of steam into transfer line reaction zones so as to reduce coking on the walls of the transfer lines.

U.S. Pat. No. 3,702,816 (U.S. Class 208/50) relates to a process for reducing sulfur content of coke obtained from high sulfur resids by hydrogenation of the residual feedstock followed by contacting the partially desulfurized residual feedstock in a liquid phase with an oxidizing agent and thereafter passing oxidized charged stock free of extraneous oxidizing agent to a coking zone.

U.S. Pat. No. 4,332,671 (U.S. Class 208/92) relates to a coking process in which the coke is treated by a high temperature calcination with oxygen to reduce its sulfur content.

U.S. Pat. No. 4,051,014 (U.S. Class 208/88) relates to a process for producing coke from sulfur-containing residual feedstocks which involves contacting the feedstock with a peroxy oxidant in the presence of a metal-containing catalyst to oxidize a portion of the hydrocarbon feedstock and subjecting the feedstock to coking conditions to form coke and recover coke product.

In coking processes, sludges have been disposed of in various manners.

In U.S. Pat. No. 4,552,649 (U.S. Class 208/127), an improved fluid coking process is described where an aqueous sludge which comprises organic waste material is added to a quench elutriator to cool the coke in the elutriator and convert at least a portion of the organic waste to vaporous compounds which can be recycled to the fluid coking heating zone to increase the temperature of the fluid coke particles therein.

In U.S. Pat. No. 3,917,564 (U.S. Class 208/131), sludges or other organic by-products are added to a delayed coking drum during a water quenching step after feed to the coke drum has been stopped and the coke drum has been steamed to remove hydrocarbon vapors. The quenching step cools the hot coke within the coke drum to a temperature that allows the coke to be safely removed from the coking drum when it is opened to the atmosphere.

The sludge is added along with the quench water and contacts the solid coke in the coke drum at conditions causing the vaporization of the water contained in the sludge. The organic and solid component of the sludge is left behind through deposition on the coke and removed from the coke drum as part of the solid coke product.

U.S. Pat. No. 4,666,585 (U.S. Class 208/131) relates to the disposal of sludge in a delayed coking process by adding sludge to the coker feedstock and subjecting the feedstock and sludge mixture to delayed coking conditions.

U.S. Pat. No. 2,043,646 (U.S. Class 202/16) discloses a process for the conversion of acid sludge into sulfur dioxide, hydrocarbons and coke in a two-step procedure comprising passing sludge into a kiln to produce semi-coke and then passing the semi-coke into a coke drum for conversion into coke product.

U.S. Pat. No. 4,874,505, Bartilucci et al. relates to a sludge addition to a delayed coking process in which the sludge is segregated into high oil content sludge and high water content sludge. These sludges are introduced into the delayed coking unit during different operating cycles of the coker.

West German Offenlegungsschrift, DE 3726206 A1, relates to a coking process in which sludge is added to the process at different locations in the coke drum.

U.S. Pat. No. 3,917,564 (U.S. Class 208/131) discloses a process in which sludges or other organic by-products are added to a delayed coking drum during a water quenching step after the feed coke drum has been stopped and the coke drum has been steamed to remove hydrocarbon vapors. The quenching step cools hot coke with the coke drum through a temperature that allows coke to be safely removed from the coking drum when it is open to the atmosphere.

U.S. Pat. No. 1,973,913 (U.S. Class 202/37) discloses a process wherein coke which has been removed from a coking oven or drum is quenched with polluted wastewater which contains tar acids. After quenching, the tar acids can remain on the coke, and the aqueous materials associated with these acids is vaporized.

U.S. Pat. No. 2,093,588 (U.S. Class 196/61) discloses a process of delayed coking in which liquid materials such as hydrocarbons or water are passed into the vapor portion of the delayed coking zone.

U.S. Pat. No. 4,501,654 (U.S. Class 208/131) teaches injection of a residual feedstock into the top of a coking drum.

In U.S. Pat. No. 4,552,649 (U.S. Class 208/127) an improved fluid coking process is described where an aqueous sludge which comprises organic waste material is added to a quench elutriator to cool the coke in the elutriator and convert at least a portion of the organic waste to vapor compounds which can be recycled to the fluid coking heating zone to increase the temperature of the fluid particles in that zone.

In U.S. Pat. No. 1,973,913 (U.S. Class 202/37), coke which has been removed from a coking oven or coking drum is quenched with polluted wastewater which contains tar acids. After quenching, the tar acids remain on the coke and the aqueous materials associated with these acids is vaporized.

U.S. Pat. No. 4,404,092 (U.S. Class 208/131) discloses a process for increasing the liquid yield of a delayed coking process by controlling the temperature of the vapor space above the mass of coke in the coke drum by injecting a quenching liquid, instead of sludge, into the vapor phase within the delayed coking drum. The patent teaches that large amounts of liquid should be added to the vapor space within a delayed coking drum (about 9 percent by weight of the feed).

SUMMARY OF THE INVENTION

The invention disclosed herein can be summarized as a coking process in which oxygen is added to a sludge stream which contacts feed, or liquid or vapor derived from the feed, and in which the feed, or liquid or vapor derived from the feed also contacts oxygen to effect oxidation of a portion of the feed, or vapor or liquid derived from the feed.

It is an object of the present invention to provide an improved coking process in which the operating temperature in the coking zone can be increased without reducing the operating factor for the coker feed furnace. It is another object of a present invention to provide increased liquid yields and decreased solid coke yields by maintaining high operating temperatures in the coking zone.

It is another object of this invention to dispose of sludge materials which may contain environmentally harmful materials by contacting a mixture of oxygen and sludge at high temperatures in a coking zone to convert the sludge to valuable and non-harmful materials.

The present invention of adding oxygen to the sludge for eventual oxidation of a portion of the sludge and adding oxygen to feed or converted liquids or vapors in a delayed coking zone overcomes one of the main problems associated with current commercially operated delayed coking processes. Even though delayed coker drums are well insulated, the coke drum vapor outlet temperature is usually 60° to 120° F. lower than the temperature in the transfer line connecting the coke drum and the feed furnace, since the coking reactions occurring in the coke drum are endothermic. Higher transfer line temperatures increased the profitability of the delayed coker operation by reducing the solid coke yield. Additionally, to produce an acceptable grade anode coke from residual feedstocks, higher transfer line temperatures are also required to meet anode coke density specifications.

The common practice in the industry to increase the transfer line temperatures is to increase feed furnace temperature. However, the higher furnace tube temperature which result are also accompanied by increased furnace tube fouling rates and the need for frequent decoking of the tubes.

It is, therefore, desirable to increase the coke drum temperature without raising the furnace temperatures. Accordingly, one aspect of the invention claimed herein meets a commercial need by increasing the transfer line temperature by adding oxygen to the transfer line causing oxidation of a portion of the feed passing through the transfer line. The oxidation reaction is exothermic and raises the temperature in the transfer line without increasing the feed furnace temperature which would be accompanied by increased furnace fouling rates. Oxygen can also be added to liquid or vapor derived from the feed or to the coke produced in the process.

Another aspect of the invention helps maintain coker operating temperatures by adding oxygen to sludge which is injected into the coker to contact feed or converted liquid or vapor or, in some cases, solid coke. The oxygen in the sludge causes a portion of the sludge to be oxidized in the coke drum, increasing its temperature and adding heat to the coker process.

Injection of the mixture of oxygen and sludge into the coking process, whether it be a delayed-coking coke drum or a fluid bed coker, allows the sludge to contact vapor or solid coke materials in the coke drum at high process temperatures which can enhance the conversion of hydrocarbons in the sludge to coke, liquid or vapor. In most cases, the toxic materials in the sludge can be converted to more environmentally acceptable materials at the high temperatures which are prevalent in a delayed coking drum as a result of oxygen addition to the sludge. Also, contacting an additional oxygen stream with feed, or vapor or liquid derived from the feed, adds more heat to the coking zone to help maintain high temperatures in the coking zone by oxidizing or combusting hydrocarbon materials in these materials.

BRIEF DESCRIPTION OF THE DRAWINGS

FIG. 1 shows an overall process flow scheme for a commercial delayed-coking process incorporating the present invention.

Figure 1:
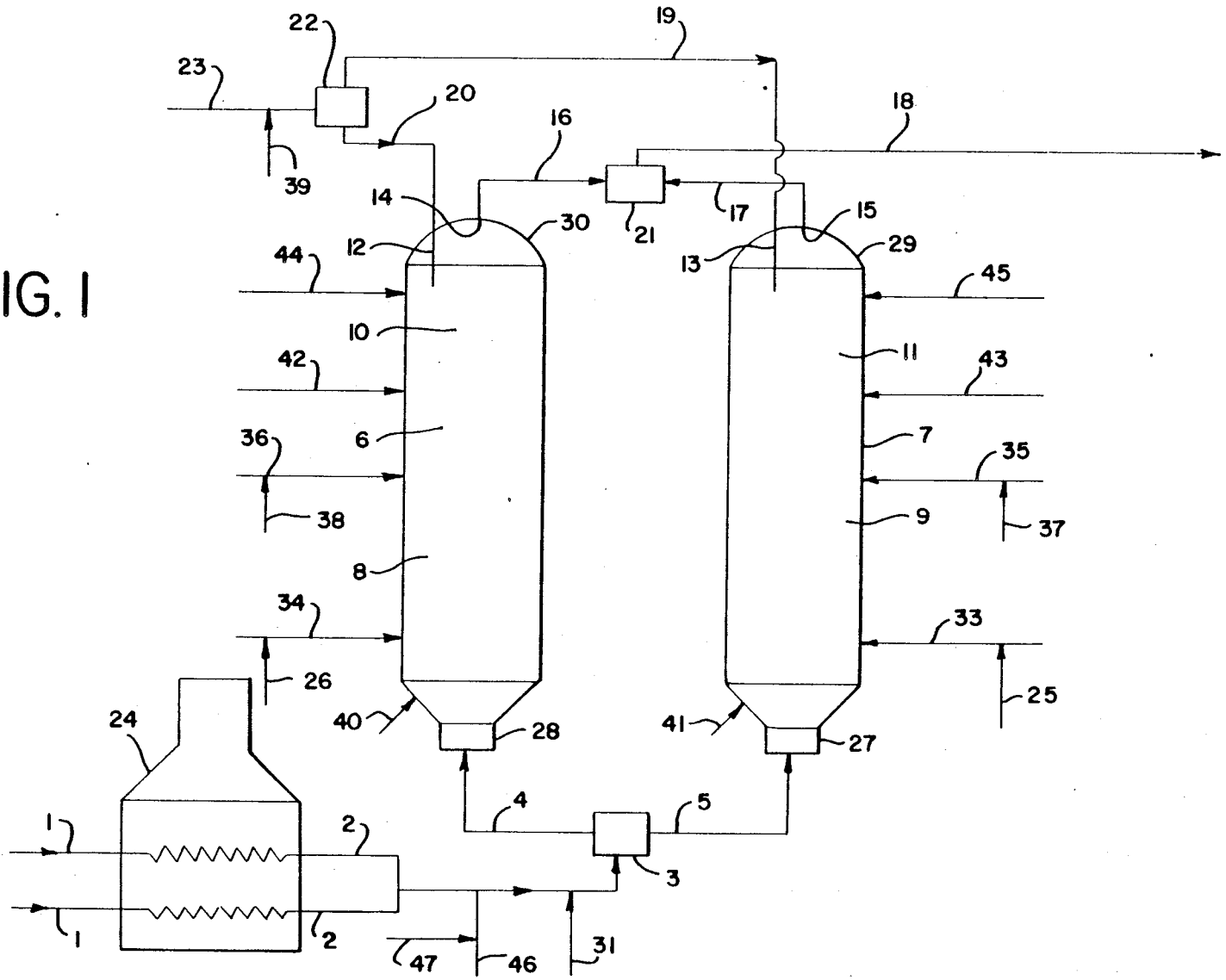
FIGS. 1 and 2 illustrate various aspects of an invention described herein.

Line 1 carries a residual or heavy feedstock through furnace heater 24. Line 2 carries heated residual feed through diverter valve 3 and into lines 4 or 5, depending on which coke drum the residual feed enters. Lines 2 and 4 or 5 which connect the furnace to the coke drum are generally referred to as the transfer line.

Line 31 carries an oxygen-containing gaseous stream which can enter the transfer line at oxidation conditions to effect oxidation of a portion of the feedstock passing through the transfer line. Optionally, the oxygen can enter the coking drum through lines 44 or 45 at its upper section where vapors derived from the feed are present, or lower in the coke drum through lines 40 or 41 where solid coke or liquid derived from the feed is present. Oxygen can also pass into the coke drums through lines 42 and 43 to contact vapor or liquid derived from the feed at a mid- location in the drum.

Since coke forms at the bottom of the coke drum initially, the solid coke level gradually rises in the drum until the drum is almost full of solid coke. There is generally a layer of liquid and foam above the top of the coke bed in the drum which also moves up the drum as the coke bed height increases.

If oxygen is to contact liquid or vapor derived from the feed in the coke drum, the injection points for oxygen addition to the drum must also be able to move upwardly with the derived liquid level.

In some cases, a manifold system can be used to add oxygen to the coke drum at one or more locations, together or alteratively, to cause oxygen to contact feed, liquid derived from the feed, or vapor derived from the feed. The manifold system can include diverter valves which regulate the location of oxygen injection into the drum as well as the quantity of oxygen injected.

Coke drums 6 and 7 are vertically positioned elongated vessels into which feed can pass through inlets 27 and 28. The heated feed within the coke drum passes in an upward direction and, via the coking reaction, is converted to solid coke which remains within the coke drum and liquid and vapor materials. The coke drums have lower sections 8 and 9, and upper sections 10 and 11, respectively. Typically, the lower sections will contain solid coke while the upper sections will generally contain vapor product which leaves the coke drums through the vapor outlets 14 and 15.

The vaporized products along with vaporized sludge leave the coke drum via vapor inlets 14 and 15 and pass into overhead transfer lines 16 or 17, pass through diverter valve 21 and into line 18 which is connected to a fractionation column for further separation.

In normal operations the diverter valves 3 and 21 isolate one of the coke drums from the process while the other coke drum is being filled with coke during a coke production cycle in which feed passes into the coking drum. The isolated coke drum no longer has feed passing into it and is cooled during a quench cycle by passing steam and liquid water to it. After quenching, the drum is opened and coke is recovered from the drum.

Sludge is contacted with oxygen and passed into the coke drum through lines 46, 33 or 34, 35, or 36, or 19 or 20, depending on whether the sludge and oxygen mixture is to contact feed, liquid derived from the feed, or vapor derived from the feed. In some cases the sludge can contact solid coke in the drum.

Oxygen passing through lines 25, 26, 37, 38, 39 and 47 contacts sludge passing through lines 33, 34, 35, 36, 23 or 46, respectively. The sludge can pass into the coke drum via a single location, or via multiple locations.

Since the sludge and oxygen mixture can contact feed, liquid derived from the feed, vapor derived from the feed or coke produced from the feed, sludge injection can be at different locations in the coke drum. As mentioned above, the top of the coke bed gradually moves up within the coke drum as solid coke is produced and fills the drum. Accordingly, the sludge injection points can change to follow the particular material the sludge is to contact in the feed line or coke drum.

In one case, sludge in line 23 can mix with oxygen passing through line 39 and pass through diverter valve 22 into lines 19 or 20 depending on which coke drum is recovering residual feed. Lines 19 and 20 carry the sludge and oxygen through the coke drum head lines 12 and 13 which are connected to lines 20 and 19, respectively, carry sludge into the upper section of the coke drum for contact with vapor derived from the feed located in the upper section of the coke drum. Preferably, these lines are in a vertical position, and even more preferably have their outlets located at a sufficient distance down from the top of the coke drum to allow the sludge to enter the coke drum at a point where there is minimal upward vapor velocity within the upper section of coke drum. This point typically will be the widest location within the coke drum.

In another case, sludge passing through line 46 can be mixed with oxygen passing through line 47 and passed into transfer line 2 which contains residual feedstock which is passed into one of the coke drums. When sludge and oxygen are added to the feed stream, oxygen can also be added separately to the feed stream through line 31 to additionally cause oxidation or combustion of a portion of the feed passing into the coking zone. In FIG. 1, the oxygen contacts the feed downstream of the sludge plus oxygen injection, however, this sequence may be reversed.

In another case, sludge which has been mixed with oxygen can pass into the lower portion of the coking drum through lines 33 or 34 where it can contact, depending on the height of the coke level within the coke drum, vapor derived from the feed, or liquid derived from the feed, or in some cases coke which has been derived from the feed material as the coke bed passes up through the coke drum. The sludge and oxygen mixture can also be passed into the middle section of the coking drum via line 35 or 36 to contact vapor derived from the feed, liquid derived from the feed or coke derived from the feed depending upon the level with the coke bed at that point in the coke drum.

Figure 2:
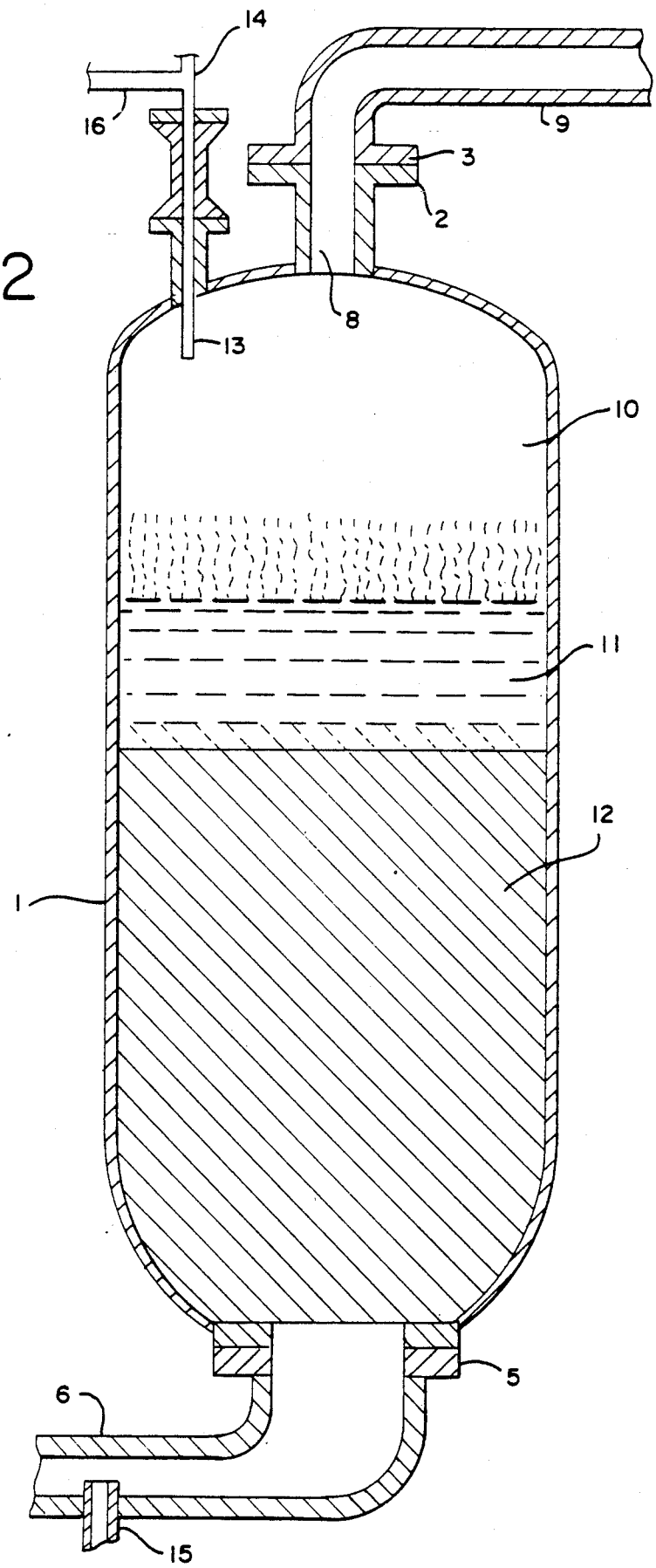

FIG. 2 shows a specific design for one aspect of the process claimed herein. In this case, sludge mixed with oxygen contacts vapor derived from the feed in the upper section of the coke drum and oxygen contacts feed.

Coke drum 1 has transfer line 6 passing into the drum through flange 5. In transfer line 6, heated residual feed can contact a gaseous stream containing oxygen which flows through line 15.

The oxygen-containing gaseous stream may pass through a single entry point or through multiple injection points to aid in the combustion of feed.

Coke drum 1 contains solid coke in a lower section 12, an interface where liquids are being converted to coke at 11, and an upper section 10 which contains vapor product leaving the interface. Residual feed passes through transfer line 6 into the coke drum where, through the coking reaction, the liquid hydrocarbon is converted to solid coke and vapor product. The vapor product eventually leaves the coke drum through vapor outlet 8 through flanges 2 and 3 and passes into line 9 which is connected to a fractionation zone.

Sludge passing through line 14 contacts oxygen passing through line 16 and enters the coke drum through line 13. The mixture of sludge and oxygen passing through line 13 contacts hot vapor located in the upper section of the coke drum at thermal conditions to effect combustion of a portion of the hydrocarbons contained in the sludge and possibly part of the vapors in the coke drum. In a preferred case, all the oxygen injected with the sludge is consumed in the coke drum so no free oxygen leaves the drum. Other manners of injecting sludge into the coke drum or coking process can be used. The oxygen may pass through a single entry point or multiple entry points on line 14 to aid in the mixing of sludge and oxygen.

DESCRIPTION OF THE PREFERRED EMBODIMENTS

In a broad embodiment, the invention relates to a coking process wherein a sludge material is passed into a coking zone and a heavy hydrocarbon feed comprising residual oil is also passed into a coking zone at coking conditions, to effect production of solid coke and lighter hydrocarbon products derived from the feed which comprises: (11) contacting the feed, liquid derived from the feed, or vapor derived from the feed with oxygen at oxidation conditions to effect oxidation of a portion of the feed, liquid derived from the feed, or vapor derived from the feed, (2) contacting the sludge with oxygen to form a mixture, and (3) passing the mixture into the coking zone at thermal treatment conditions to contact at least a portion of the feed, liquid derived from the feed, or vapor derived from the feed.

In another aspect of the invention, a more specific embodiment relates to a delayed coking process having an elongated, vertically positioned coke drum containing an upper section and a lower section, wherein a residual feed, at least a portion of which boils in the range of from about 850° F. up to about 1250° F., is passed through a furnace to be heated. The heated feed is thereafter passed through a transfer line comprising a conduit and into a lower section of the coke drum at coking conditions including a feed temperature of from about 850° F. to about 970° F., a coke drum pressure of from about atmospheric to about 250 psig, and a coke drum vapor residence time of from about a few seconds up at about ten minutes to effect production of solid coke and lighter hydrocarbon products comprising liquid and vapor derived from the feed and wherein solid coke is contained in said lower section, and vapor, which is contained in said upper section, is removed from the coke drum through a vapor outlet connected to said upper section, wherein: (1) a gaseous stream comprising oxygen is introduced into feed passing through the transfer line at oxidation conditions to effect oxidation of a portion of the feedstock in the transfer line, and wherein substantially all of the oxidation of the feed occurs in the transfer line, and substantially complete consumption of the oxygen contacted with the feed occurs in the transfer line, (2) contacting sludge comprising liquid water, hydrocarbons, and solid materials with a gaseous stream comprising oxygen at oxidation conditions to effect oxidation of a portion of the sludge, and (3) passing the sludge and oxygen mixture into the upper section of the coke drum at thermal treatment conditions including a sludge addition rate of from about 0.01 to about 10 percent by weight based on the feed addition rate to the coking drum to effect contact of the sludge and oxygen mixture with vapor in said upper section and vaporization of at least a portion of the sludge and oxidation of a portion by hydrocarbons contained in the sludge.

Coking operations in most modern refineries produce solid coke, and vapor products from heavy residual oil feedstocks which are fed to the coking process. The coking process can be either a delayed coking or a fluidized coking operation.

In fluid coking, a feedstock contacts a fluidized bed of coke particles maintained at a sufficiently high temperature to effect conversion of the feed into solid coke particles and lighter liquid and vapor materials which are recovered from the fluidized bed. Part of the solid coke formed in this operation is passed into a separate gasifier vessel where it is burned to produce additional heat. This heat is recycled back into the fluid bed of coke particles in the reaction section through higher temperature coke particles which provide heat to help maintain process operations.

In the more usual application of the coking process, a delayed coking drum is used. A heavy residual oil is heated in a furnace, passed through a transfer line and then into the coking drum. In the coking drum, which is typically an elongated vessel, the residual feedstock is thermally decomposed to a heavy tar or pitch material which further decomposes with time into solid coke and vapor materials. The vapor materials formed during the coking reaction are recovered from the delayed coking drum and a solid coke material is left behind.

After a period of time the feed to the coke drum is stopped and routed to another drum and the coke-laden drum is then purged of vapors, cooled and opened so that solid coke inside the drum can be removed.

The coking reaction is endothermic causing the temperature to drop as the formation of coke, liquid and vapor products occur within the coke drum. This temperature drop can start when the feed material leaves the feed furnace and passes through the transfer line connecting the furnace to the coke drum. A temperature drop also occurs in the delayed coking drum where most of the coking reactions occur.

The endothermic coking reaction causes the vapor products leaving the coke drum through the coke drum vapor outlet to normally be cooler than the feed entering the coke drum. The vapor which is leaving the interface between the vapor and the solid coke phases within the coke drum is also cooler than the solid coke in the bottom of the drum. The temperature drop between the residual feed entering the bottom of the coke drum and the vapor material leaving the coke drum vapor outlet will be approximately about 90° to 110° F. for normal operations.

The addition of oxygen to the feed, liquid derived from the feed, vapor derived from the feed, or even solid coke within the coke drum at oxidation conditions helps to supplement the heat requirements of the coking zone by causing combustion which is exothermic, yielding additional energy to the zone and helping to maintain high temperatures in the coking zone. By also adding oxygen to the sludge at the thermal treatment conditions to cause oxidation or combustion which is exothermic, additional energy is imparted to the coking zone and high temperatures can be maintained. This results in both improved yields of liquid products, lower yields of solid coke, and increased conversion of sludge to more valuable and less toxic materials.

Coking conditions include the use of heavy hydrocarbons such as residual feedstocks which pass into the coking drum through a transfer line maintained at a temperature anywhere from about 850° F. to about 970° F., preferably around 900° F. to 950° F. For needle coke production where decanted oils are used as feedstocks, the transfer line temperature will be higher—generally from about 950° F. to about 970° F.

Coking operations generally use a furnace with heating tubes through which the feed oil to be coked is passed and heated to a temperature above 800° F. to about 970° F., and preferably from 850° F. to 970° F. at pressures from atmospheric to about 250 psig, preferably from about 15 to about 150 psig. Coking zone vapor residence time normally will be from about a few seconds up to ten minutes or more.

Under normal coking conditions, the hydrocarbon vapor products in the upper section of the coke drum can vary in temperature from about 740° F. to 880° F., depending on the transfer line temperature, heat losses through the coke drum, and the endothermic heat of reaction for coke production. If a steam or hydrocarbon quench is used in the top of the coke drum, or if sludge is injected to the coke drum or mixed with feed, the temperature of the vapors in the top of the coke drum can be reduced. In such cases, the temperature of the vapors leaving the coke drum vapor outlet can be below 780° F. to about 800° F. However, this can increase internal liquid recycle inside the coke drum, and if large quantities of quench hydrocarbons are used, reduced feed throughput to the coking unit can result if drum capacity or cycle time is limited.

Sludge which is introduced along with oxygen into the claimed process typically comprises organic and inorganic waste materials mixed with water and generally in the form of a mixture of one or more liquids often with solids. Individual sludges, as shown in Table I below, can vary greatly in the concentrations of water, solids and liquid organic materials (such as hydrocarbon oil) depending on the source of the sludge. They can be in the form of suspensions, emulsions, or slurries and generally contain large amounts of water. In some cases the sludge can comprise only liquid materials and in other cases the sludge can comprise a thick slurry of heavy liquids and solid material.

When the individual sludges are combined for addition to the coking zone, the composition of the combined sludge can comprise anywhere from less than one up to about 15 weight percent or more solids, from less than one up to about 15 weight percent or more hydrocarbon oils, and anywhere from a few up to 98 weight percent or more water.

In some cases the sludge can comprise water and hydrocarbon oil with very little, if any, solids. The individual sludges may comprise anywhere from less than one up to 80 or more weight percent solids, from less than one up to 80 or more weight percent of hydrocarbon oils, and anywhere from a few up to 98 weight percent or more water.

The oil or organic material may be solid, semi-solid or a liquid material and is generally a hydrocarbonaceous material. The solid may comprise organic or inorganic material and, in some cases, can comprise both. Preferably, the aqueous sludge is an industrial sludge derived from wastewater treatment plants of petroleum refineries or petrochemical plants comprising hydrocarbonaceous materials.

Table I below shows sludge production and solids and hydrocarbon oils contents (the remaining material being water) for aqueous wastewater sludges found in a typical refinery producing a broad range of refinery products:

TABLE I

| Aqueous Wastewater Sludge Description | Solids Wt % | Oil Wt % | Pounds Per Day |
|---|---|---|---|
| API Separator Bottoms | 3.9 | 2.5 | 6,600 |
| Slop Oil Emulsions | — | 84.0 | 3,280 |

TABLE I-continued

| Aqueous Wastewater Sludge Description | Solids Wt % | Oil Wt % | Pounds Per Day |
|---|---|---|---|
| Leaded Tank Bottoms | 6.1 | — | 30 |
| Unleaded Tank Bottoms | 66.0 | 12.0 | 3,030 |
| Heat Exchange Sludge | 17.0 | — | 6 |
| Oily Waste | — | 7.7 | 55 |
| MEA Reclaimer Sludge | 6.2 | 0.2 | 99 |
| ASP Sludge from Digester | 2.0 | 0.34 | 22,600 |
| Average | 7.6 | 9.4 | 35,700 Total |

When a mixture of sludge and a gaseous stream comprising oxygen are added to the coking zone, the mixture is added to the coking zone to effect contact of at least a portion of the sludge with at least a portion of the feed, or liquid derived from the feed or vapor products, or combinations of these three components. When the sludge contacts the feed, it can be injected into the transfer line or into the part of the coking zone where feed first enters the coke drum or the fluidized coking reactor. The liquid derived from the feed can be partially converted feed which can further react vapors and coke.

Preferably, sludge contacts the vapors formed in the coking zone although the combination of sludge addition with addition of a gaseous oxygen stream to the coking zone can be practiced with sludge addition to the coking zone feed or to locations in the coking zone where partially converted feed is present.

The sludge is added to the coking zone at thermal treatment conditions which include a temperature high enough to convert the sludge to vapors and, if cokeable materials are present, to coke. Thermal treatment conditions also include contact of the sludge with oxygen and the oxidation of at least a part of the sludge.

Thermal treatment conditions also can include the contact of sludge with oxygen at sufficiently high temperatures to cause at least a partial oxidation of the sludge followed by injection of the sludge into the coke drum or coking zone for further contact with vapor liquid feed or coke materials to further cause vaporization or additional oxidation of the sludge or the materials it contacts, or both, within the coking zone. If thermal treatment conditions are regulated so as to cause oxidation of some of the sludge prior to its contact with feed, vapor, liquid or coke materials within the coking zone, the sludge would preferably be preheated prior to or during the oxygen mixing stage so as to reach a sufficiently high temperature to cause oxidation of the sludge to occur.

Thermal treatment conditions include sufficiently high temperatures anywhere from above 300° F., and preferably above 500° F., up to 950° F. or higher which will primarily cause oxidation of hydrocarbons contained within the sludge. Thermal treatment temperatures generally represent the temperature of the material that the sludge and oxygen mixture contacts when injected into the coking zone. These materials can be feed, liquid or vapor derived from the feed, or coke. They generally are at a temperature above about 700° F. in the coking zone. Preferably, thermal treatment conditions include consumption (through oxidation) of essentially all the oxygen injected with the sludge into the coking zone and include a temperature anywhere preferably from around 700° F. up to or higher than 900° F. At higher temperatures the oxidation of hydrocarbon in the sludge will cause combustion and production of water and carbon dioxide products from the materials combusted in the sludge. The thermal treatment conditions preferably will also cause any hydrocarbon materials or toxic materials within the sludge which are cokeable to be produced into solid coke and lighter, more valuable and less toxic hydrocarbons.

The thermal treatment conditions in a preferred sense include both high temperature oxidation or combustion coupled with the resulting conversion of heavier hydrocarbons or toxic materials contained in the sludge into relatively harmless or inert coke-like materials and more valuable and less environmentally hazardous light hydrocarbons, or lighter materials which can be recovered from the coking zone.

When the sludge and oxygen mixture contacts hot vapors within the coking zone, thermal treatment conditions include contact of the sludge and oxygen with vapor products and the resulting combustion or oxidation of appropriate sludge components. When the sludge plus oxygen mixture contacts liquid derived from the feed, the temperature should be sufficiently high to allow combustion or oxidation of at least a portion of the hydrocarbons in the sludge and any toxic materials contained in the sludge. When the sludge and oxygen mixture contact feed it should be at sufficiently high temperatures to allow the oxygen contacted with the sludge to cause combustion or oxidation of a portion of the hydrocarbons present within the sludge material. When the sludge plus oxygen mixture contacts solid coke within the coking zone, temperatures should be high enough to cause oxidation and preferably combustion of least a portion of the hydrocarbon contained within the sludge.

Preferably, the sludge and oxygen mixture injected into the coking zone is regulated so as to encourage maximum combustion of sludge material at a point where the sludge is mixed with the hydrocarbon or coke within the coking zone.

The amount of oxygen mixed with the sludge which is injected into one or more of the above-described locations in the coking zone can vary depending on the composition on the sludge being injected, the temperature of the sludge being injected, the material that the sludge and oxygen contact within the coking zone (vapors, liquid derived from the feed, coke, or feedstock) and the temperature of the hydrocarbon or coke material that the sludge contacts within the coking zone.

Approximately 24 standard cubic feet of oxygen per pound of hydrocarbon contained within the sludge is a useful gauge of the amount of oxygen which can be used. A preferred range is anywhere from around 5 to about 100 or more standard cubic feet of oxygen per pound of hydrocarbon contained in the sludge.

It is preferable to regulate the amount of oxygen contained in the sludge contacting the feed, or coke, liquid or vapor derived from the feed, so that substantially all of the oxygen which is injected with the sludge into the coking zone is consumed by the sludge or the hydrocarbon or coke which the sludge and oxygen contact within the coking zone. If too much oxygen is supplied with the sludge and it is not given an opportunity to fully react with hydrocarbons, oxygen could accumulate in vapor lines within the coking process causing a potentially hazardous situation. Accordingly, it is especially preferred that the oxygen combust or react with sludge or hydrocarbon or carbon within the coking zone within a reasonably close proximity of the sludge injection point to prevent build-up of free oxygen in the coking process.

Thermal treatment conditions also include a preferred sludge addition rate of from about 0.1 to about 10 percent by weight, more preferably from about 0.1 to 5 percent by weight, based on the feedstock addition rate to the coking drum. It is most preferable to maintain the sludge addition rate below 1 weight percent of the feedstock addition rate to the coke drum.

When sludge is injected into the upper section of a coke drum, thermal treatment conditions can include a rate of from about 0.1 to about 10 percent by weight, based on the feedstock addition rate to the coking drum; sufficient temperature in the upper section of the coke drum to vaporize substantially all the water and vaporizable hydrocarbons which may be present in the sludge; thermally decomposing at least a portion of the heavy hydrocarbons in the sludge to coke; and injection of the sludge into the upper section of the coke drum at a point where the upward velocity of vapor in the drum will not entrain liquid or solids from the sludge.

In a more preferred instance, thermal treatment conditions include injection of the sludge into the upper section of the coke drum at a location where there is minimum upward vapor velocity of vapors within the upper section of the coke drum. This is preferred to prevent carry over of solids or heavy hydrocarbons contained in the sludge before decomposition can take place. This material can cause fouling of coke drum vapor outlet lines and associated downstream processing equipment.

In the case of a fluid coking operation, the sludge can be passed into the upper section of a fluidized coking reaction vessel where small quantities of fluidized coke particles exist or the sludge can be passed directly into the dense bed of fluidized coke particles near the bottom of the vessel. The sludge can also be combined with the feed to the fluid coking reactor.

In delayed coking, since it is important to maintain relatively high temperatures in the upper section of the coke drum during sludge addition, the addition of sludge will take place during the coke producing cycle of operations (when feedstock is being added to the coking drum).

To prevent the sludge from causing excess corrosion, inhibitors can be added as well as antifoaming agents.

In cases where a large amount of water is present in the sludge, coker recycle liquids may be mixed with the sludge to help preheat the sludge before it enters the coking zone. In these cases sludge may be pretreated by removing some of the water by filtering, centrifuging or similar operations.

In some cases where the sludge contains no cokeable materials, thermal treatment conditions include vaporization of the sludge, or thermal decomposition of the sludge into vaporous materials along with oxidation of at least a portion of the sludge.

The mixture of sludge and oxygen can be contacted with (1) the feed material which is passing into the coking zone, (2) liquid which is derived from the feed by conversion of the feed in the coking zone, (3) vapor materials which have been derived from the feedstock and are present within the coking zone, or (4) solid coke material which is present within the coking zone. The mixture of oxygen and sludge may be injected into any of the above locations within the coking zone, singularly or in combination with injection of sludge and oxygen into other portions of the coking zone.

For instance, sludge contacted with oxygen may be injected both into the feed stream passing into the coking zone and either the liquid derived from the feed, vapor derived from the feed, or coke within the coking zone. In certain cases the mixture of sludge plus oxygen could be injected into the coking zone to contact three or all of the above described streams simultaneously. In cases where multiple injection points of the mixture of oxygen and sludge occur, a manifold system may be used to regulate the entry points of the oxygen plus sludge mixture into the coking zone. Particularly, when the sludge plus oxygen mixture is to contact liquid derived from the feed within the coking zone, the injection point of the sludge plus oxygen would generally move in an upward direction within the coking zone since the liquid level contained within the coking zone, which often time rests above the solid coke bed, would be moving up within the coking zone during the coke production cycle.

In addition to contacting oxygen with sludge, oxygen also mixes with feed, liquid derived from the feed, vapor derived from the feed and in some cases coke produced in the coking zone, and causes the oxidation and preferably consumption of the hydrocarbon or carbon-containing materials contained within these various materials. This adds addition heat to the coking zone helping maintain high temperatures in the coking zone.

Oxygen can be contained with one or more of the feed, liquid derived from the feed, vapor derived from the feed or coke produced from the feed in the coking zone. In cases where multiple injection points of oxygen occur, a manifold system can be used to regulate the quantity of oxygen which passes into these various materials and the location of the oxygen within the coking zone to contact these materials.

Oxidation conditions for contacting of oxygen with feed, liquid derived from the feed, vapor derived from the feed or even coke include temperatures from above 300° F. to 350° F., and preferably above 500° F. up to 970° F. or higher. The oxygen rate of addition to feed, liquid derived from the feed, vapor derived from the feed or coke would generally be about 24 standard cubic feet of oxygen injection into the streams per pound of hydrocarbon or carbon material desired to be combusted or oxidized. A broader range would be anywhere from about 5 up to about 100 or more standard cubic feet of oxygen per pound of hydrocarbon or carbon in the material desired to be combusted.

As with oxygen, contact with the sludge and subsequent injection in the coking zone, the oxygen contacting feed, liquid derived from the feed, vapor derived from the feed or coke should be regulated so that little, if any, oxygen escapes these hydrocarbon streams and works its way into other locations of the coking zone in order to prevent a potentially hazardous explosive mixture from occurring. Preferably, the oxidation conditions include the substantially complete, if not totally complete, consumption of oxygen in either of these streams.

The oxygen-containing gas which contacts the sludge and feed, or liquor of vapor derived from the feed, or coke, can comprise air or pure or purified oxygen. The gas can also comprise air or oxygen in combination with a combustible light gas such as methane or natural gas. Depending on the control system which is used to monitor the flow of oxygen, an inert gas such as nitrogen or steam, or an unreactive material such as a relatively inert hydrocarbon, may be blended with oxygen or air to allow for effective and safer control of oxidation or combustion taking place within the stream to which it is mixed.

The use of a combustible light gas mixed with the oxygen-containing gas can allow ignition of the mixture prior to its contact with sludge or the above described feed, vapor liquid or coke. This can help induce a high localized temperature which can assure rapid, but controlled, oxidation of these materials with little chance for free oxygen to enter the downstream coking apparatus.

When adding the oxygen-containing gas to the feed passing through the transfer line it preferably should be done through multiple injection nozzles to allow good contact of the oxygen with the feed. This can be done through use of spargers or other mechanisms which will allow the oxygen-containing gas passed into the transfer line to be intimately contacted with the heated feedstock passing through the transfer line. This helps promote oxidation or combustion of a portion of the feed and substantially complete consumption of the oxygen contained in the oxygen-containing gas.

The oxygen in the upper portions of the coke drum and downstream units should be closely monitored. In some cases, the carbon dioxide level may be monitored. By monitoring these component level, the oxygen level in the coking zone can be kept well below the explosion envelope at the prevailing conditions in the coke zone. Usually the oxygen level will be kept below 10 volume percent and most often well below 4 volume percent concentration in the vapor being monitored.

The equivalent of from 0.01 up to 1 weight percent or more of the feed passing into the transfer line can be combusted through contact with the oxygen-containing gas passing in the coking zone.

EXAMPLE 1

In this Example three cases were generated to show the benefits associated with the use of increased transfer line temperatures resulting from the combustion in the transfer line of reside feed passing into the delayed coking drum by oxygen addition to the feed coupled with contact of sludge with oxygen and thereafter injecting the sludge into the upper section of the coke drum.

The Base Case represented the yields for a delayed coking process in which the transfer line temperature is maintained at 870° F. and no oxygen was added to the transfer line.

Case A represented an operation in which oxygen was added to sludge and the mixture was injected into the vapor contained in the upper section of the coke drum. The transfer line temperature was also increased above the Base Case by 30° F. by the addition of oxygen through multiple injection points in the transfer line going into the delayed coking drum.

Case B illustrates the yields associated with a 60° F. increase in transfer line temperature over the Base Case, and a 30° F. increase in transfer line temperatures over Case A. In case B sludge and oxygen were added to the coke drum at the same rate as for Case A.

In all three runs the feedstock had an atomic hydrogen-to-carbon ratio of 1.4448, a sulfur content of 3.4 wt. %, a nitrogen content of 0.60 wt. %, vanadium in the concentration of 165 ppm, a rams carbon value of 17.8 wt. %, an API of 6.6° and a nickel concentration of 55 ppm. The sludge injection rate for Cases A and B was 2 gallons per minute and air was mixed with the sludge prior to injection into the upper section of the coke drum. The sludge used had the average composition shown in Table I.

For all three runs the same overall operating conditions were maintained except for the sludge addition and varying the air activation rates to the transfer line temperature and the sludge streams. The delayed coker modeled was a commercial-coking unit located in an operating refinery. The delayed coking feed rate was set at approximately 25,500 barrels per stream day. The pressure at the outlet of the coking drum was maintained at 35 psig, and steam addition to the coking drum and transfer line was maintained at 2,400 pounds per hour. The unit was operated with a 12-hour cycle time (the time for a complete cycle of the delayed coking drums operations from initially adding residual feed to an empty drum through removing the solid coke from the drum).

In the Base Case, a normal delayed coking operation was simulated, and the yields and properties of the various components produced are reported in Table II. Cases A and B which show the invention herein (sludge contact with oxygen and injection into the drum and oxygen contact with the feed) were simulations with transfer line temperatures of 900° F. and 930° F., respectively. These cases report both pure oxygen and alternatively, the air feed rates to the feed and sludge stream. There is little difference in the reported results when pure oxygen, or alternatively, when air is used as the combustion gas.

All three cases are reported in Table II below.

Also the yields reported for Cases A and B do not include yield effects resulting from the additional hydrocarbon and inorganic solids present in the sludge fed to the cokers. The quantity of sludge addition (2 gallons per minute) is so low compared to the coker feed rate (25,000 barrels per stream day) that no measurable effects could be noticed taking into account the precision of the measurement and analytical techniques used to predict the yields.

TABLE II

| | Base Case | Case A | Case B |
|---|---|---|---|
| Transfer Line Temp., °F. | 870 | 900 | 930 |
| Feed Oxidized, Barrels/Day | — | 60.5 | 99 |
| Feed Oxidized, Wt. % of Feed | — | 0.23 | 0.39 |
| Rate of Oxygen Contact with Feed, SCFH | — | 20,295 | 33,210 |
| Rate of Air Contact with Feed, SCFH | — | 96,643 | 58,143 |
| Rate of Sludge Addition, GPM | — | 2.0 | 2.0 |
| Rate of Oxygen Contact with Sludge, SCFH | — | 1190 | 1300 |
| Date of Air Contact with Sludge, SCFH | — | 5668 | 6235 |
| Product Yields | | | |
| $C_4$-Gas*, Wt. % | 9.21 | 10.31 | 11.49 |
| $C_5$ to 200° F. | | | |
| Wt. % | 1.65 | 0.77 | 1.99 |
| Volume % | 2.44 | 2.66 | 2.97 |
| API, Degrees | 73.4 | 72.6 | 71.9 |
| Sulfur, Wt. % | 0.23 | 0.25 | 0.26 |
| Nitrogen, PPM | 44 | 52 | 9 |
| 200 to 360° F. | | | |
| Wt. % | 5.12 | 5.69 | 6.25 |
| Volume % | 6.85 | 7.62 | 8.39 |
| API, Degrees | 53.1 | 53.1 | 53.1 |
| Sulfur, Wt. % | 0.47 | 0.50 | 0.52 |

TABLE II-continued

| | Base Case | Case A | Case B |
|---|---|---|---|
| Nitrogen, PPM | 115 | 144 | 173 |
| 360 to 650° F. | | | |
| Wt. % | 31.50 | 29.45 | 27.30 |
| Volume % | 37.50 | 35.06 | 32.52 |
| API, Degrees | 32.9 | 32.9 | 32.9 |
| Sulfur, Wt. % | 1.37 | 1.45 | 1.52 |
| Nitrogen, Wt. % | 0.10 | 0.10 | 0.10 |
| 650°+ F. | | | |
| Wt. % | 18.06 | 19.69 | 21.33 |
| Volume % | 19.58 | 21.18 | 22.77 |
| API, Degrees | 18.2 | 17.1 | 15.9 |
| Sulfur, Wt. % | 1.89 | 2.11 | 2.33 |
| Nitrogen, Wt. % | 0.31 | 0.36 | 0.40 |

*Excludes products of combustion with oxygen.

As can be seen from the data reported in Table II above, the increased transfer line temperatures resulted in certain process advantages to the refiner. Also, the addition of a sludge plus air mixture did not allow the vapors leaving the top of the coke drum to cool as a result of the sludge added to the upper portion of the coke drum. Combustion of the hydrocarbons in the sludge in the coke drum, as a result of the air in the injected sludge, helped maintain temperature in the upper section of the coke drum. The coke yield resulting from the higher transfer line temperatures was reduced from approximately 34.46 wt. % for the Base Case to 31.25 wt. % for Case B. In all Cases the total liquids produced—that is $C_5$+ liquids—increased with the increased transfer line temperatures. An additional benefit achieved from practicing the process of this invention is that the density of the coke produced in Cases A and B was increased.

EXAMPLE II

In this Example data was generated for two case studies to determine the feasibility of adding oxygen to the feed of a delayed coking unit while also considering the effects of adding oxygen to a sludge stream being added to the coke drum.

The coke drum used in the studies had an approximate inside diameter of 18 feet. Sludge was injected only during the coking cycle and through a vertical tube which passed through the coke drum head. During sludge addition, the residual feed rate to the coke drum was set at approximately 7000 barrels per day of vacuum resid derived from a mixture of Jobo and Trinidad based crudes. Coke production was targeted to produce a fuel grade coke. A sludge having the average composition shown in Table I was injected into the upper section of the coke drum at a rate of approximately 2 gallons per minute. No oxygen was added to the sludge.

The sludge injection reduced the overhead vapors leaving the drum about 30° F. (from about 825° F. to about 795° F.).

In order to make up for this reduction in overhead vapor temperature, air was injected into the feed in the transfer line and mixed with the sludge before injection into the upper section of the coke drum. Approximately 150 standard cubic feet per minute of air was injected into the feed transfer line at conditions to effect oxidation of a portion of the feed passing through the transfer line and about 60 standard cubic feet per minute of air was injected into the sludge to effect oxidation of the hydrocarbons contained in the sludge. Oxidation in each case amounted to combustion of hydrocarbons in the feed and in the sludge.

The combustion of feed occurred in the feed transfer line and combustion of the hydrocarbons in the sludge occurred in the upper section of the coke drum in contact with vapor derived from the feed.

The oxygen addition to the sludge increased the overhead vapor temperature by about 30° F.

We claim as our invention:

1. A coking process wherein a sludge material is passed into a coking zone and a heavy hydrocarbon feed comprising residual oil is also passed into a coking zone at coking conditions, to effect production of solid coke and lighter hydrocarbon products derived from the feed which comprises: (1) contacting feed, liquid derived from the feed, or vapor derived from the feed with oxygen at oxidation conditions to effect oxidation of a portion of the feed, liquid derived from the feed, or vapor derived from the feed, (2) contacting the sludge with oxygen to form a mixture, and (3) passing the mixture into the coking zone during the coke production cycle at thermal treatment conditions to contact at least a portion of the feed, liquid derived from the feed, or vapor derived from the feed.

2. The process of claim 1 further characterized in that feed contacts oxygen and effects oxidation of the feed.

3. The process of claim 1 further characterized in that liquid derived from the feed contacts oxygen and effects oxidation of the liquid derived from the feed.

4. The process of claim 1 further characterized in that vapor derived from the feed contacts oxygen and effects oxidation of said vapors.

5. The process of claim 1 further characterized in that the feed is passed through a furnace to be heated, thereafter passed through a transfer line and into the coking zone and oxygen contacts the feed passing through the transfer line to effect oxidation of a portion of the feed in the transfer line.

6. The process of claim 1 further characterized in that the mixture is added to the coking zone as a stream separate from the feed and contacts the vapor in the coking zone.

7. The process of claim 1 further characterized in that the mixture is added to the coking zone as a stream separate from the feed and contacts the liquid derived from the feed in the coking zone.

8. The process of claim 1 further characterized in that oxygen contacts feed to effect oxidation of a portion of the feed and said mixture of sludge and oxygen thereafter contacts feed.

9. The process of claim 1 further characterized in that at least a portion of said feed boils in the range of from about 850° F. up to about 1250° F. or higher; said coking conditions include a feed temperature of from about 850° F. to about 970° F., a coking zone pressure of from about atmospheric to about 250 psig, and a coking zone vapor residence time of from about a few seconds up to ten or more minutes; and a sludge addition rate of from about 0.01 to about 10 percent by weight, based on the feed addition rate to the coking zone.

10. The process of claim 1 further characterized in that said process is a delayed coking process having an elongated vertically positioned coke drum containing an upper section and a lower section, the feed is a residual feed which is passed through a furnace to be heated, the heated feed is thereafter passed through a transfer line comprising a conduit and into a lower section of the coke drum, solid coke is contained in the lower section and vapor is contained in the upper section, and wherein vapor is removed from the coke drum through a vapor outlet connected to said upper section, oxygen is introduced into feed passing through the transfer line at oxidation conditions, and the mixture of sludge and oxygen is passed into the transfer line to contact the feed at thermal treatment conditions.

11. The process of claim 1 further characterized in that said process is a delayed coking process having an elongated vertically positioned coke drum containing an upper section and a lower section, the feed is a residual feed which is passed through a furnace to be heated, the heated feed is thereafter passed through a transfer line comprising a conduit and into a lower section of the coke drum, a solid coke is contained in the lower section and vapor is contained in the upper section, and wherein vapor is removed from the coke drum through a vapor outlet connected to said upper section, oxygen is introduced into feed passing through the transfer line at oxidation conditions, and the mixture of sludge and oxygen is passed into the lower section of the drum to contact liquid derived from the feed at thermal treatment conditions.

12. The process of claim 1 further characterized in that said process is a delayed coking process having an elongated vertically positioned coke drum containing an upper section and a lower section, the feed is a residual feed which is passed through a furnace to be heated, the heated feed is thereafter passed through a transfer line comprising a conduit and into a lower section of the coke drum, solid coke is contained in the lower section and vapor is contained in the upper section, and wherein vapor is removed from the coke drum through a vapor outlet connected to said upper section, oxygen is introduced into feed passing through the transfer line at oxidation conditions, and the mixture of sludge and oxygen is passed into the upper section of the drum to contact vapor derived from the feed at thermal treatment conditions.

13. The process of claim 1 further characterized in that thermal treatment conditions include vaporization of at least a portion of the sludge and combustion of at least a portion of hydrocarbon contained in the sludge by the oxygen contacted with the sludge.

14. The process of claim 13 further characterized in that oxygen contacted with the sludge is substantially consumed by said combustion of hydrocarbon contained in the sludge.

15. A coking process wherein a heavy hydrocarbon feed comprising residual oil is passed into a coking zone at coking conditions, to effect production of solid coke and lighter hydrocarbon products derived from said feed which comprises: (1) introducing into the feed prior to passage into the coking zone a gaseous stream comprising oxygen at conditions to effect oxidation of a portion of the feed, (2) contacting sludge with oxygen to form a mixture, and (3) passing said mixture into the coking zone during the coke production cycle at thermal treatment or vapor derived from the feed.

16. The process of claim 15 further characterized in that the mixture is added to the coking zone as a stream separate from the feed and contacts the vapor in the coking zone.

17. The process of claim 15 further characterized in that the mixture is added to the coking zone as a stream separate from the feed and contacts the liquid derived from the feed in the coking zone.

18. The process of claim 15 further characterized in that the mixture contacts feed.

19. The process of claim 15 further characterized in that said sludge is contacted with oxygen at thermal treatment conditions to effect oxidation of a portion of the sludge and thereafter passed into the coking zone.

20. The process of claim 15 further characterized in that said process is a delayed coking process having an elongated vertically positioned coke drum containing an upper section and a lower section, the feed is a residual feed which is passed through a furnace to be heated, the heated feed is thereafter passed through a transfer line comprising a conduit and into a lower section of the coke drum, solid coke is contained in the lower section and vapor is contained in the upper section, and wherein vapor is removed from the coke drum through a vapor outlet connected to said upper section, oxygen is introduced into feed passing through the transfer line at oxidation conditions, and the mixture of sludge and oxygen is passed into the transfer line to contact the feed at thermal treatment conditions.

21. The process of claim 15 further characterized in that said process is a delayed coking process having an elongated vertically positioned coke drum containing an upper section and a lower section, the feed is a residual feed which is passed through a furnace to be heated, the heated feed is thereafter passed through a transfer line comprising a conduit and into a lower section of the coke drum, solid coke is contained in the lower section and vapor is contained in the upper section, and wherein vapor is removed from the coke drum through a vapor outlet connected to said upper section, oxygen is introduced into feed passing the transfer line at oxidation conditions, and the mixture of sludge and oxygen is passed into the lower section of the drum to contact liquid derived from the feed at thermal treatment conditions.

22. The process of claim 15 further characterized in that said process is a delayed coking process having an elongated vertically positioned coke drum containing an upper section and a lower section, the feed is a residual feed which is passed through a furnace to be heated, the heated feed is thereafter passed through a transfer line comprising a conduit and into a lower section of the coke drum, solid coke is contained in the lower section and vapor is contained in the upper section, and wherein vapor is removed from the coke drum through a vapor outlet connected to said upper section, oxygen is introduced into feed passing through the transfer line at oxidation conditions, and the mixture of sludge and oxygen is passed into the upper section of the drum to contact vapor derived from the feed at thermal treatment conditions.

23. The process of claim 15 further characterized in that thermal treatment conditions include vaporization of at least a portion of the sludge and combustion of at least a portion of hydrocarbon contained in the sludge by the oxygen contacted with the sludge.

24. The process of claim 23 further characterized in that oxygen contacted with the sludge is substantially consumed by said combustion of hydrocarbon contained in the sludge.

25. A coking process wherein a heavy hydrocarbon feed comprising residual oil is passed into a coking zone at coking conditions, to effect production of solid coke and lighter hydrocarbon products from said feed which comprises: (1) contacting at least a portion of the liquid derived from the feed with oxygen at conditions to effect combustion in the coking zone of a portion of said liquid derived from the feed, (2) contacting sludge with oxygen to form a mixture, and (3) passing said mixture to the coking zone during the coke production cycle at thermal treatment conditions to contact at least a portion of the feed, liquid derived from the feed, or vapor derived from the feed.

26. The process of claim 25 further characterized in that the mixture is added to the coking zone as a stream separate from the feed and contacts the vapor in the coking zone.

27. The process of claim 25 further characterized in that the mixture is added to the coking zone as a stream separate from the feed and contacts the liquid derived from the feed in the coking zone.

28. The process of claim 25 further characterized in that said mixture thereafter contacts feed.

29. The process of claim 25 further characterized in that said sludge is contacted with oxygen at thermal treatment conditions to effect oxidation of a portion of the sludge and thereafter passed into the coking zone.

30. The process of claim 25 further characterized in that said process is a delayed coking process having an elongated vertically positioned coke drum containing an upper section and a lower section, the feed is a residual feed which is passed through a furnace to be heated, the heated feed is thereafter passed through a transfer line comprising a conduit and into a lower section of the coke drum, solid coke is contained in the lower section and vapor is contained in the upper section, and wherein vapor is removed from the coke drum through a vapor outlet connected to said upper section, oxygen is introduced into the lower section of the coke drum to contact liquid derived from the feed at oxidation conditions to effect oxidation of at least a portion of the liquid derived from the feed, and the mixture of sludge and oxygen is passed into the transfer line to contact the feed at thermal treatment conditions.

31. The process of claim 25 further characterized in that said process is a delayed coking process having an elongated vertically positioned coke drum containing an upper section and a lower section, the feed is a residual feed which is passed through a furnace to be heated, the heated feed is thereafter passed through a transfer line comprising a conduit and into a lower section of the coke drum, solid coke is contained in the lower section and vapor is contained in the upper section, and wherein vapor is removed from the coke drum through a vapor outlet connected to said upper section, oxygen is introduced into the lower section of the coke drum to contact liquid derived from the feed at oxidation conditions to effect oxidation of at least a portion of the liquid derived from the feed, and the mixture of sludge and oxygen is passed into the lower section of the coke drum to contact liquid derived from the feed at thermal treatment conditions.

32. The process of claim 25 further characterized in that said process is a delayed coking process having an elongated vertically positioned coke drum containing an upper section and a lower section, the feed is a residual feed which is passed through a furnace to be heated, the heated feed is thereafter passed through a transfer line comprising a conduit and into a lower section of the coke drum, solid coke is contained in the lower section and vapor is contained in the upper section, and wherein vapor is removed from the coke drum through a vapor outlet connected to said upper section, oxygen is introduced into the lower section of the coke drum to contact liquid derived from the feed at oxidation conditions to effect oxidation of at least a portion of the liquid derived from the feed, and the mixture of sludge and oxygen is passed into the upper section of the coke drum to contact vapor derived from the feed at thermal treatment conditions.

33. The process of claim 25 further characterized in that thermal treatment conditions include vaporization of at least portion of the sludge and combustion of at least portion of hydrocarbon contained in the sludge by the oxygen contacted with the sludge.

34. The process of claim 33 further characterized in that oxygen contacted with the sludge is substantially consumed by said combustion of hydrocarbon contained in the sludge.

35. A coking process wherein a heavy hydrocarbon feed comprising residual oil is passed into a coking zone at coking conditions, to effect production of solid coke and lighter hydrocarbon products comprising liquid and vapor derived from derived from said feed which comprises: (1) contacting at least a portion of the vapor derived from the feed with oxygen at conditions to effect combustion in the coking zone of a portion of said liquid derived from the feed, (2) contact the sludge with oxygen to form a mixture, and (3) passing the mixture into the coking zone during the coke production cycle at thermal treatment conditions to contact at least a portion of the feed, liquid derived from the feed, or vapor derived from the feed.

36. The process of claim 35 further characterized in that the mixture is added to the coking zone as a stream separate from the feed and contacts the vapor in the coking zone.

37. The process of claim 35 further characterized in that the mixture is added to the coking zone as a stream separate from the feed and contacts the liquid derived from the feed in the coking zone.

38. The process of claim 35 further characterized in that the mixture thereafter contacts feed.

39. The process of claim 35 further characterized in that said process is a delayed coking process having an elongated vertically positioned coke drum containing an upper section and a lower section, the feed is a residual feed which is passed through a furnace to be heated, the heated feed is thereafter passed through a transfer line comprising a conduit and into a lower section of the coke drum, solid coke is contained in the lower section and vapor is contained in the upper section, and wherein vapor is removed from the coke drum through a vapor outlet connected to said upper section, oxygen is introduced into the upper section of the coke drum to contact vapor derived from the feed at oxidation conditions to effect oxidation of at least a portion of the vapor derived from the feed, and the mixture of sludge and oxygen is passed into the transfer line to contact the feed at thermal treatment conditions.

40. The process of claim 35 further characterized in that said process is a delayed coking process having an elongated vertically positioned coke drum containing an upper section and a lower section, the feed is a residual feed which is passed through a furnace to be heated, the heated feed is thereafter passed through a transfer line comprising a conduit and into a lower section of the coke drum, solid coke is contained in the lower section and vapor is contained in the upper section, and wherein vapor is removed from the coke drum through a vapor outlet connected to said upper section, oxygen is introduced into the upper section of the coke drum to contact vapor derived from the feed at oxidation conditions to effect oxidation of at least a portion of the vapor derived from the feed, and the mixture of sludge and oxygen is passed into the lower section of the coke drum to contact liquid derived from the feed at thermal treatment conditions.

41. The process of claim 35 further characterized in that said process is a delayed coking process having an elongated vertically positioned coke drum containing an upper section and a lower section, the feed is a residual feed which is passed through a furnace to be heated, the heated feed is thereafter passed through a transfer line comprising a conduit and into a lower section of the coke drum, solid coke is contained in the lower section and vapor is contained in the upper section, and wherein vapor is removed from the coke drum through a vapor outlet connected to said upper section, oxygen is introduced into the upper section of the coke drum to contact vapor derived from the feed at oxidation conditions to effect oxidation of at least a portion of the vapor derived from the feed, and the mixture of sludge and oxygen is passed into the upper section of the coke to contact vapor derived from the feed at thermal treatment conditions.

42. The process of claim 35 further characterized in that thermal treatment conditions include vaporization of at least portion of the sludge and combustion of at least a portion of hydrocarbon contained in the sludge by the oxygen contact with the sludge.

43. The process of claim 42 further characterized in that oxygen contact with the sludge is substantially consumed by said combustion of hydrocarbon contained in the sludge.

* * * * *

UNITED STATES PATENT AND TRADEMARK OFFICE

CERTIFICATE OF CORRECTION

PATENT NO. : 5,110,449

DATED : May 5, 1992

INVENTOR(S) : Dean G. Venardoe, et al

It is certified that error appears in the above-indentified patent and that said Letters Patent is hereby corrected as shown below:

| Column | Line(s) | |
|---|---|---|
| 1 | 47 | Printed text reading "to a cooking zone" should read --to a coking zone-- |
| 1 | 59-60 | Printed text reading "contributed substantial" should read --contribute substantial-- |
| 2 | 23 | Printed text reading "Also by coking" should read --Also any coking-- |
| 7 | 35 | Printed text reading "vapor inlets 14" should read --vapor outlets 14-- |
| 7 | 48-49 | Printed text reading "lines 46, 33 or 34, 35, or 36, or 19 or 20," should read --lines 46, 33 or 34, 35 or 36, or 19 or 20,-- |
| 8 | 2 | Printed text reading "drum head lines 12" should read --drum head. Lines 12-- |

UNITED STATES PATENT AND TRADEMARK OFFICE

CERTIFICATE OF CORRECTION

PATENT NO. : 5,110,449 Page 2 of 4

DATED : May 5, 1992

INVENTOR(S) : Dean G. Venardoe, et al

It is certified that error appears in the above-indentified patent and that said Letters Patent is hereby corrected as shown below:

| Column | Line(s) | |
|---|---|---|
| 10 | 62 | Printed text reading "from about 850°F" should read --from around 850°F-- |
| 15 | 22 | Printed text reading "preferably consumption" should read --preferable consumption-- |
| 15 | 27 | Printed text reading "can be contained" should read --can be contacted-- |
| 15 | 60 | Printed text reading "or liquor or vapor" should read --or liquid or vapor-- |
| 16 | 25 | Printed text reading "component level" should read --component levels-- |
| 16 | 62 | Printed text reading "ratio of 1.4448," should read --ratio of 1.448.-- |
| 17 | 26 | Printed text reading "sludge stream." should read --sludge streams.-- |

UNITED STATES PATENT AND TRADEMARK OFFICE

CERTIFICATE OF CORRECTION

PATENT NO. : 5,110,449 Page 3 of 4

DATED : May 5, 1992

INVENTOR(S) : Dean G. Venardoe, et al

It is certified that error appears in the above-indentified patent and that said Letters Patent is hereby corrected as shown below:

| Column | Lines | |
|---|---|---|
| 18 | 16 | Printed text should read --TABLE II (continued) |

| | Base Case | Base Case | Base Case |
|---|---|---|---|
| Coke | | | |
| Wt.% | 34.46 | 32.86 | 31.25 |
| Sulfur, Wt.% | 4.77 | 4.77 | 4.77 |
| Nitrogen, Wt.% | 1.49 | 1.52 | 1.55 |
| Volatiles (ASTM D-3175), Wt.% | 19.90 | 16.12 | 12.34 |
| Nickel, PPM | 160 | 167 | 176 |
| Vanadium, PPM | 479 | 502 | 528 |
| Other Metals, PPM | 119 | 125 | 131 |

--

| | | |
|---|---|---|
| 19 | 6 | Printed text reading "by about 30°F" should read --by about 30°F to 35°F.-- |

UNITED STATES PATENT AND TRADEMARK OFFICE

CERTIFICATE OF CORRECTION

PATENT NO. : 5,110,449

DATED : May 5, 1992

INVENTOR(S) : Dean G. Venardoe, et al

It is certified that error appears in the above-indentified patent and that said Letters Patent is hereby corrected as shown below:

| Column | Line(s) | |
|---|---|---|
| 23 | 7 | Printed text reading "least portion" should read --least a portion-- |
| 23 | 8 | Printed text reading "least portion" should read --least a portion-- |
| 23 | 22 | Printed text reading "(2)contact" should read --(2)contacting-- |
| 24 | 38 | Printed text reading "the coke to" should read --the coke drum to-- |
| 24 | 43 | Printed text reading "least portion" should read --least a portion-- |
| 24 | 45 | Printed text reading "contact with" should read --contacted with-- |
| 24 | 47 | Printed text reading "oxygen contact" should read --oxygen contacted-- |

Signed and Sealed this

Twenty-ninth Day of June, 1993

*Attest:*

*Attesting Officer*

Michael K. Kirk

MICHAEL K. KIRK

*Acting Commissioner of Patents and Trademarks*